United States Patent [19]

Greene et al.

[11] 4,388,008

[45] Jun. 14, 1983

[54] AUTOMATIC PAPER FEEDER

[75] Inventors: Jay R. Greene, Middleville; James W. Windecker, Jr., Ilion; James H. Roberts, West Winfield; Harold F. Wood, Herkimer, all of N.Y.

[73] Assignee: Advanced Terminals, Inc., Mohawk, N.Y.

[21] Appl. No.: 237,516

[22] Filed: Feb. 23, 1981

[51] Int. Cl.[3] ..... B41J 13/00; B65H 3/44

[52] U.S. Cl. ..... 400/578; 271/9; 400/625

[58] Field of Search ..... 400/578, 605, 611, 616, 400/616.2, 624, 625, 629, 690; 271/9, 264, 145, 184–187, 2; 101/232; 226/101, 102

[56] References Cited

U.S. PATENT DOCUMENTS

| | | | |
|---|---|---|---|
| 3,989,236 | 11/1976 | Komori et al. | 271/9 |
| 4,009,957 | 3/1977 | Suzuki et al. | 271/9 |
| 4,108,427 | 8/1978 | Komori et al. | 271/9 |
| 4,131,274 | 12/1978 | Sue | 271/9 |
| 4,221,375 | 9/1980 | Morrison et al. | 271/9 X |
| 4,227,800 | 10/1980 | Nezu | 271/9 X |
| 4,234,261 | 11/1980 | Hendrischk et al. | 400/616.2 X |
| 4,252,453 | 2/1981 | Estabrooks | 400/625 |
| 4,253,652 | 3/1981 | Steinhilber | 271/9 |
| 4,272,180 | 6/1981 | Satomi et al. | 271/9 X |
| 4,303,235 | 12/1981 | Calabrese | 271/9 |

OTHER PUBLICATIONS

Brown et al., "Dual Paper Cassettes with Common Feed Mechanism," IBM Tech. Discl. Bulletin, vol. 23, No. 7A, 12/80, pp. 2683–2685.

Klein et al., "Multi-Cartridge Sheet Feed & Delivery Apparatus," IBM Tech. Discl. Bulletin, vol. 21, No. 12, May 1979, pp. 4751–4752.

McAllaster et al., "Paper Feed Module," vol. 23, No. 7A, 12/80, pp. 2677–2678.

*Primary Examiner*—E. H. Eickholt

*Attorney, Agent, or Firm*—Bruns & Jenney

[57] ABSTRACT

An automatic paper feeder for use with a character printer, the feeder having a dual cartridge capability and, alternatively, the capability of feeding envelopes to the printer. The feeder is constructed so that cut sheets or envelopes leaving the printer are delivered to a receiving station in a first in-first out arrangement. The dual cartridges are adapted to contain the cut sheets and either one or both of the cartridges can be inserted in the feeder for any given run. When both cut sheet cartridges are used the first and second sheets of a two page letter, for example, can be sequentially printed. Simultaneous use of both cartridges also permits sheets of different size and/or weight to be programmed into the feeder. In addition to cut sheets and envelopes, the feeder of the invention can be utilized for feeding continuous forms or the feeder can be deactivated to permit printing on a single "pre-empt" sheet. The feeder is provided with an outer sound minimizing housing that encloses both the feeder and the character printer.

17 Claims, 9 Drawing Figures

AUTOMATIC PAPER FEEDER

BACKGROUND OF THE INVENTION

This invention relates generally to word processing equipment, and has particular reference to a novel automatic paper feeder for use with known types of character printers.

Automatic paper or sheet feeding attachments for character printers are presently available from a number of manufacturers. Originally, these auxiliary paper feeders provided for a single cartridge or cassette containing a stack of cut sheets of paper that were fed into the printer a sheet at a time.

Single cartridge paper feeders were followed by feeders having a dual cartridge capability whereby the first and second sheets of a two page letter, for example, can be sequentially printed. Dual cartridge feeders also permit sheets of different size and/or weight to be programmed into the feeder if desired. Dual cartridge feeders as described are the feeders that are the most widely used with character printers at the present time.

In addition to paper feeders having single and dual cartridges for cut sheets, feeders have been developed for envelopes and other feeders have been developed for feeding continuous forms to a printer, the latter being known as pin or tractor feeders. In spite of these different capabilities, a single feeder capable of effectively performing all of them has not been developed heretofore to the best of applicants' knowledge. There exists a need for such a feeder in view of the growing use and importance of word processing equipment.

SUMMARY OF THE INVENTION

The automatic paper feeder of the present invention is adapted to feed to a character printer cut sheets from either one or both of a pair of cut sheet cartridges or, alternatively, to feed envelopes to the printer from a special envelope cartridge. For each cartridge there are roller and guide means for successively delivering single sheets or envelopes to the printer. Paper leaving the printer after having been printed upon is guided by the feeder to a receiving or stacking station, the feeder being constructed so that the paper is delivered to the station in a first in-first out arrangement.

When both cut sheet cartridges are employed, the feeder can be programmed so that the first and second sheets of a two page letter, for example, can be sequentially printed. Use of both of the cut sheet cartridges also permits sheets of different size and/or weight to be programmed into the feeder.

The paper feeder disclosed herein also includes an interface unit which may have incorporated therein a pin or tractor feed assembly that can be utilized for printing on continuous forms. In addition, the feeder can be deactivated to permit printing on a single "pre-empt" sheet if required. To minimize the sound of the printer and feeder to an acceptable level, the feeder is provided with an outer, foam lined housing that encloses both units.

DESCRIPTION OF THE PREFERRED EMBODIMENTS

Figure 1:
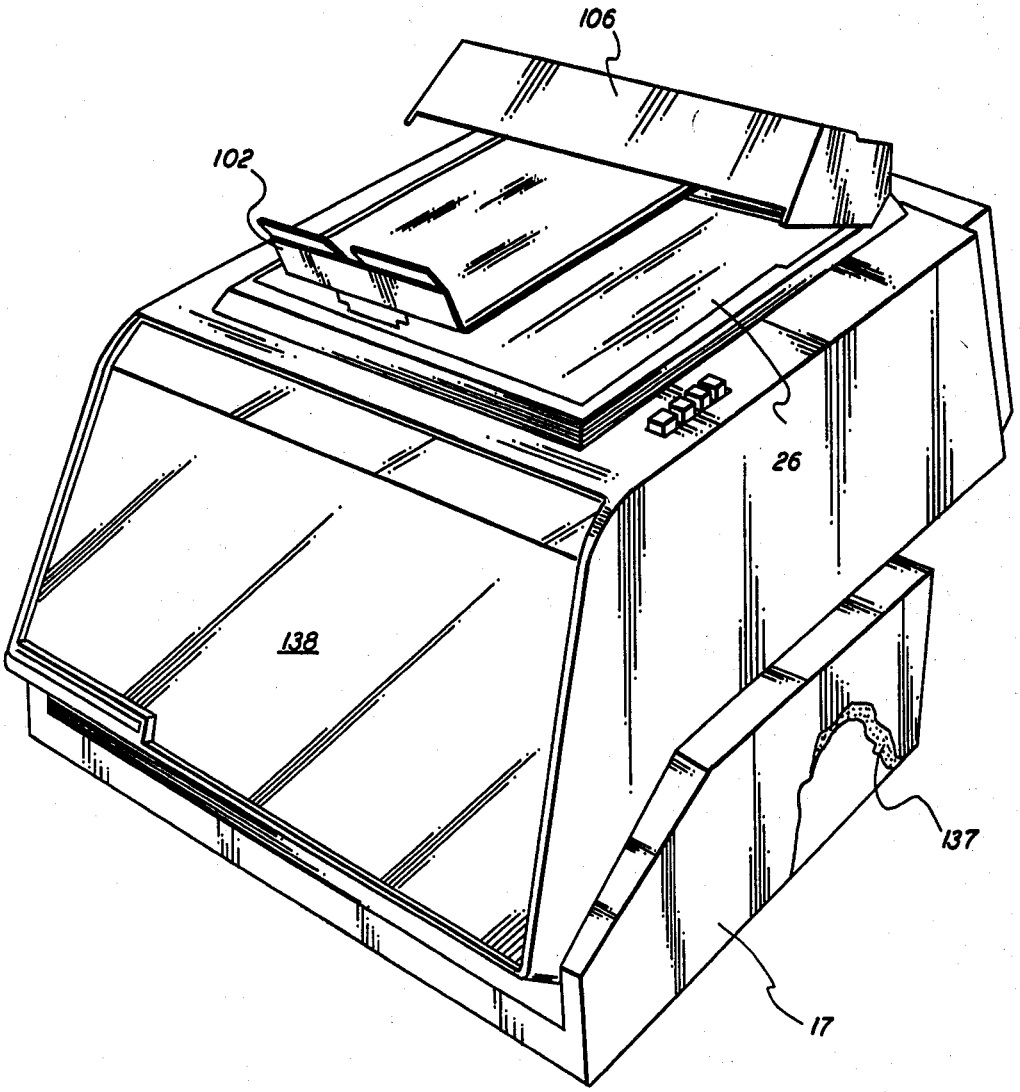
FIG. 1 is a front perspective view of the outer sound minimizing housing that encloses the paper feeder of the invention and the character printer on which the feeder is mounted.
Figure 2:
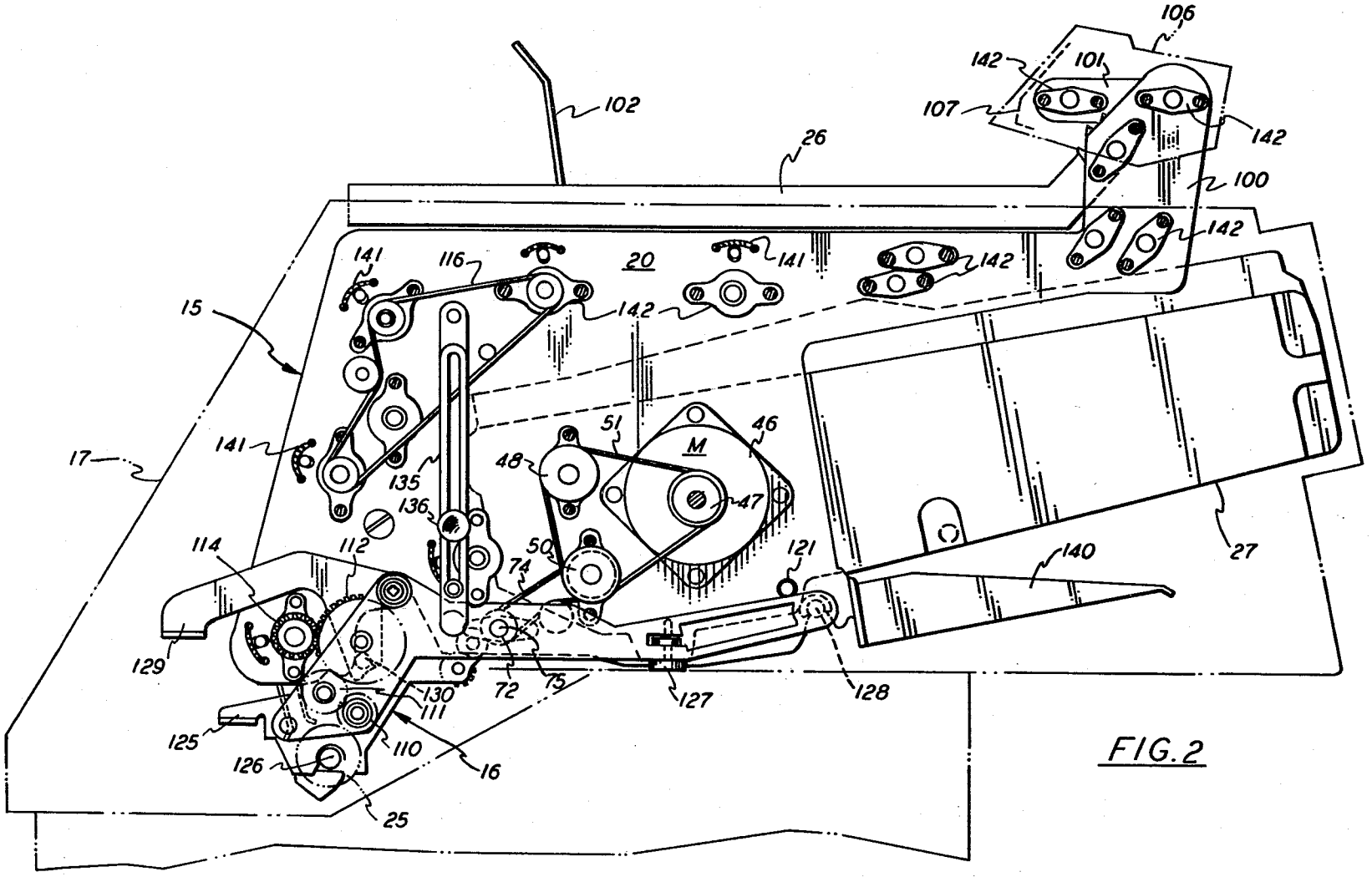
FIG. 2 is a side elevation of the right side of the paper feeder with the outer housing shown in phantom lines.
Figure 3:
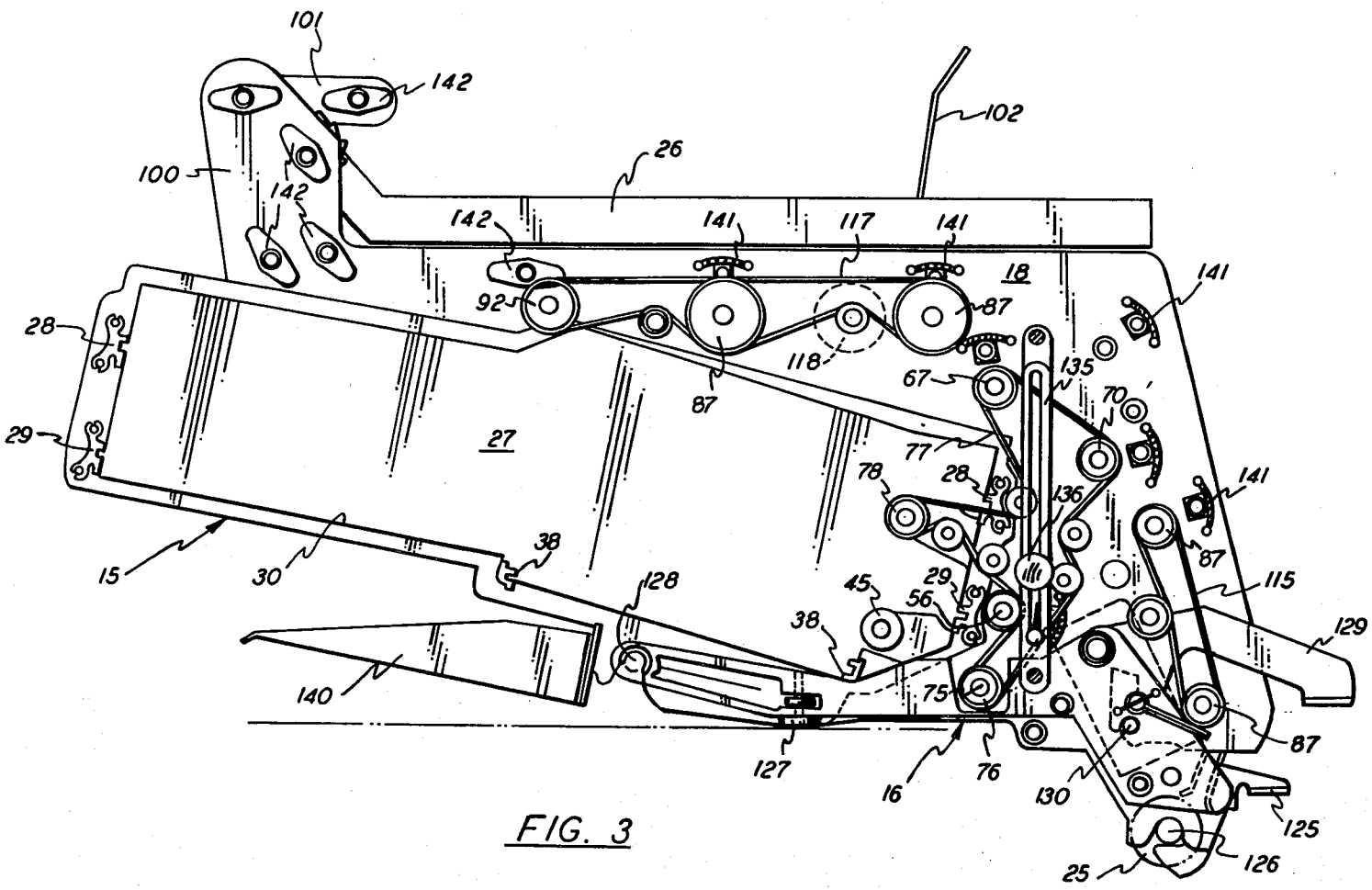
FIG. 3 is a left side elevation of the paper feeder.

Referring now to the drawings, and with particular reference to FIGS. 1–3, the automatic paper feeder of the invention is comprised of three main parts which are the paper cartridge-paper guide unit generally indicated at 15, FIGS. 2 and 3, the interface unit generally indicated at 16 and the outer, sound minimizing housing 17 shown in FIG. 1 and in phantom lines in FIG. 2. The housing 17 is not essential to the operation of the feeder but is a very desirable feature. The paper cartridge-paper guide unit 15, hereinafter usually referred to as the cartridge-guide unit, is rockably mounted on the interface unit 16 in a manner to be described hereinafter. The interface unit is in turn mounted on the character printer (not shown) and is constructed so that it can be readily attached to any of the presently most widely used printers.

Figure 4:
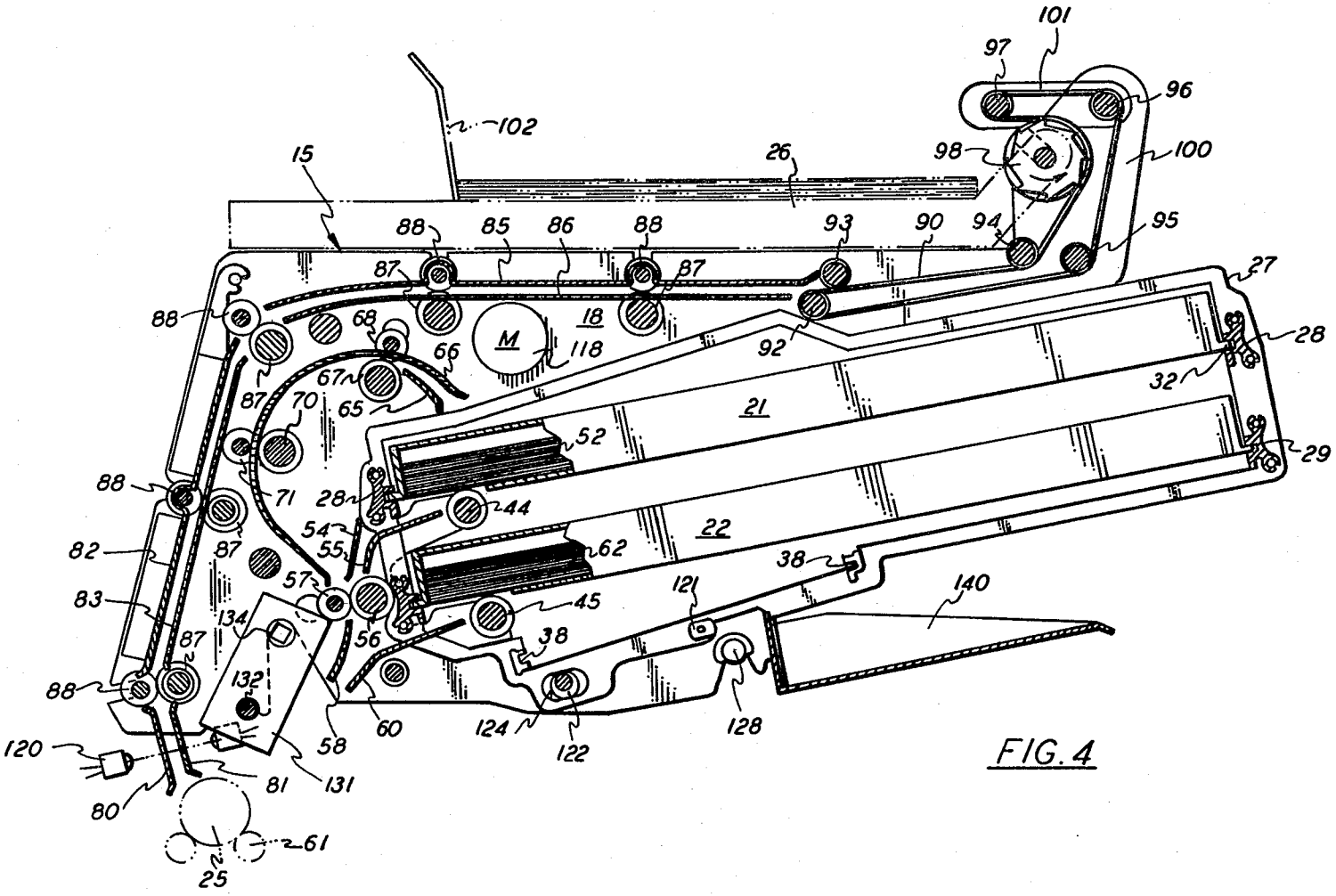
FIG. 4 is a vertical section through the paper feeder with parts broken away to show details of the cut paper cartridge construction.
Figure 5:
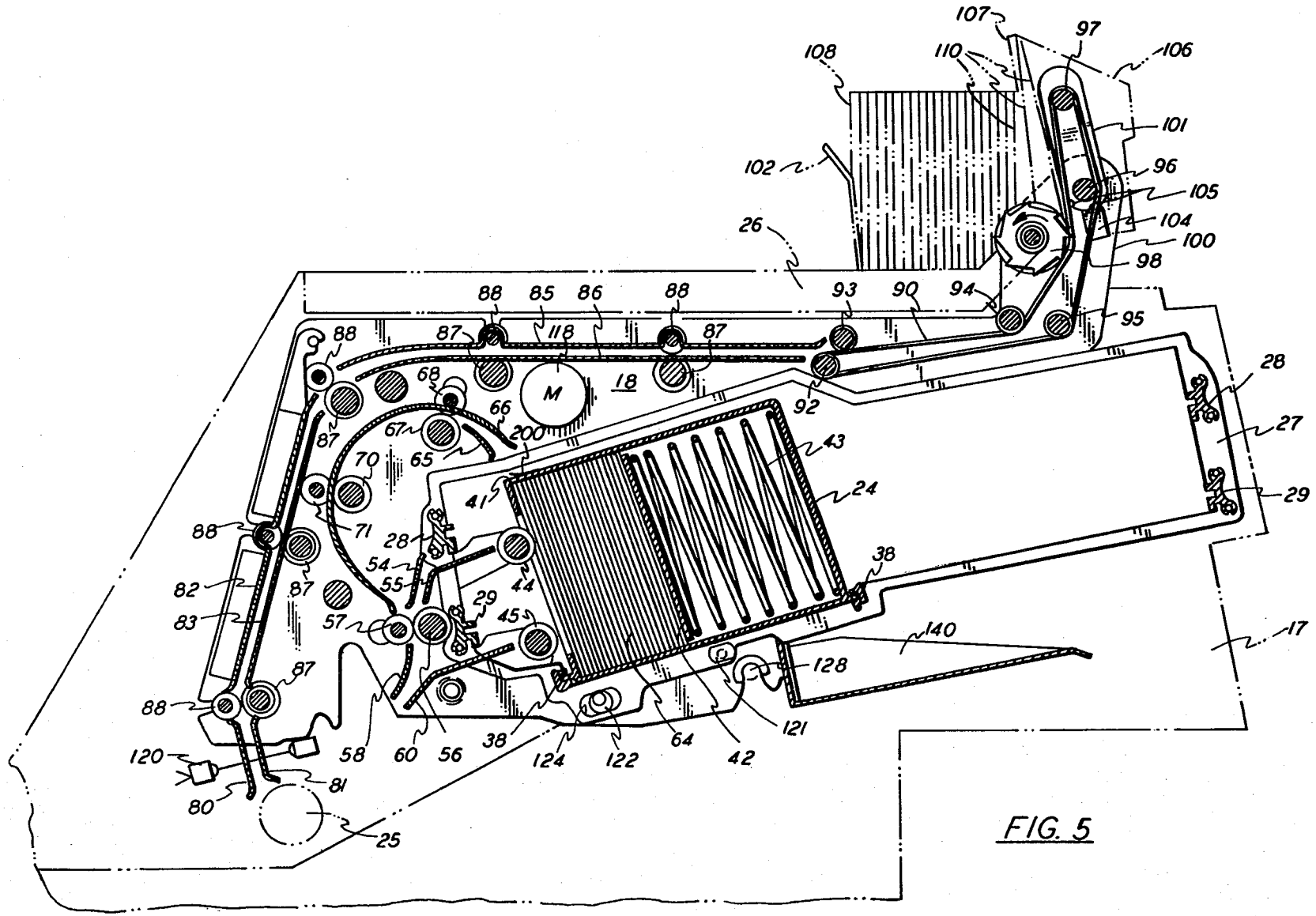
FIG. 5 is a vertical section corresponding to FIG. 4 but showing an envelope cartridge rather than a pair of cut paper cartridges.

The cartridge-guide unit 15 includes left and right side plates 18 and 20 secured together by suitable structural members, not shown. The unit 15 is arranged so that it can accommodate a pair of cut paper containing cartridges, 21,22 as shown in FIG. 4 or, in the alternative, an envelope containing cartridge 24 as shown in FIG. 5. Means to be described are provided in the cartridge-guide unit 15 and interface unit 16 to guide a sheet of paper or an envelope to the printer platen shown in phantom lines at 25, and other means to be described are provided for guiding the paper leaving the platen to a receiving station 26, FIGS. 1–5, on the cartridge guide-unit 15. Throughout the specification and claims, it is intended that the generic term "paper" include cut or single sheets, envelopes and continuous forms.

As shown in FIG. 4, the upper and lower cut paper cartridges 21 and 22 are received in a cartridge cradle assembly 27 rockably mounted in the cartridge-guide unit 15 in a manner to be described. The upper paper cartridge 21 is supported in the cradle assembly by a pair of guideways 28 and the lower paper cartridge 22 is supported by guideways 29. These guideways also guide the cartridges as they are inserted into or removed from the unit 15 through an access opening 30, FIG. 3, in the left side plate 18 thereof. The outer housing 17 is provided on its left side with a hinged door (not shown) giving access to the opening 30.

Figure 8:
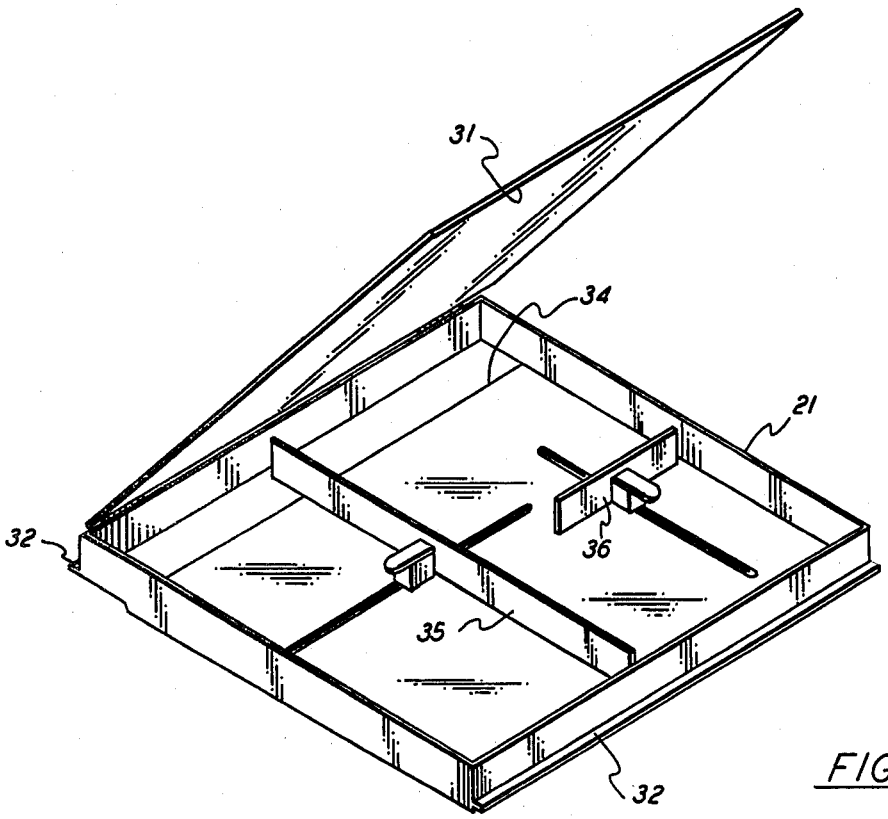
FIG. 8 is a top perspective view of a cut paper containing cartridge with its lid open.

Upper and lower paper cartridges 21,22 are identical in construction and reference is made to FIG. 8 illustrating an upper cartridge 21 with its hinged lid 31 in raised position. The cartridge is formed with flanges 32 at opposite lower edges which flanges are received in the guideways 28 as shown in FIG. 4. A bottom opening 34 adjacent one side of the cartridge permits the bottom sheet of a stack of sheets loaded into the cartridge to be engaged by a scrub roll to be described. The upper and lower cartridges can accommodate sheets ranging in size from 5.5"×5.5" up to 14"×14", and slidable guide bars 35,36 are provided in the interior of the cartridge for engaging and keeping in alignment the side and bottom edges of a stack of sheets of a particular size. Adjustable guide bars as shown are well known in the art.

Figure 9:
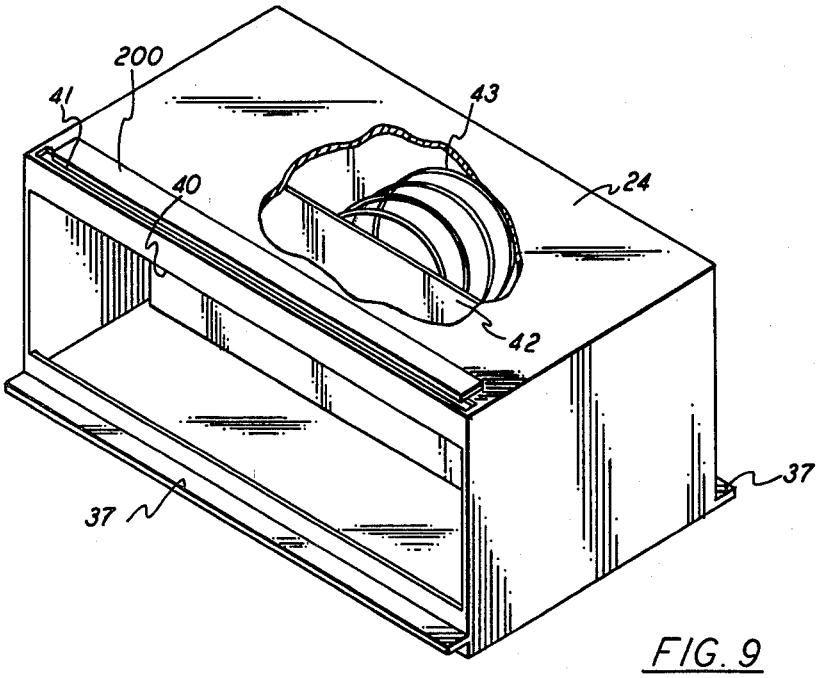
FIG. 9 is a top perspective view of an envelope containing cartridge with a portion broken away to illustrate a detail of construction.

When the paper feeder is to feed envelopes rather than cut paper, the paper cartridges 21 and 22 are removed and an envelope containing cartridge 24 as shown in FIGS. 5 and 9 is substituted. Cartridge 24 is provided with opposite lower edge flanges 37 that are received in guideways 38 in the cartridge guide unit 15. The envelope cartridge is formed with a front opening 40 through which the front envelope of a vertical stack can be engaged by a scrub roll to be described. The envelope engaged by the scrub roll is ejected from the cartridge through a narrow top opening 41. Top opening 41 is restricted by an appropriate plastic flexure beam 200 acting as a variable width throat to provide for the varying thickness of an envelope, and to prevent multiple feeding. The envelopes in a stack are biased into engagement with the scrub roll by a movable vertical plate 42 and compression spring 43.

Referring to FIG. 4, the scrub roll for the upper paper cartridge 21 is shown at 44 and the scrub roll for the lower paper cartridge 22 at 45. The upper scrub roll 44 also serves as the scrub roll for the envelope cartridge 24 as shown in FIG. 5. The scrub rolls are driven by a stepping motor 46, FIG. 2, a pulley 47 on the motor shaft driving scrub roller clutches 48,50 through a timing belt 51.

When, under program control, a sheet of paper is to be fed from the upper paper cartridge 21, FIG. 4, the scrub roll 44 feeds the lowermost sheet in the stack 52 into a paper guide assembly comprising a first pair of guide plates 54 and 55, a pair of guide rollers 56,57 and a second pair of guide plates 58,60. The plates 58,60 guide the sheet between guide rollers (not shown) in the interface unit 16 and from thence into the nip of the usual idler rollers 61 at the rear of the platen.

When a sheet of paper is to be fed from the lower cartridge 22, FIG. 4, the scrub roll 45 for that cartridge feeds the lowermost sheet in the stack 62 into a paper guide assembly comprised of the guide plates 58,60. From plates 58,60 the paper follows the same path as paper from the upper cartridge 21., i.e., between rollers in the interface unit 16 and then into the nip of the idler rollers 61. It should be noted that the cut paper in the lower cartridge 22 may differ from that of upper cartridge 21 in size and/or weight, and further that the feeder can be programmed to feed from these cartridges alternately as, for example, in printing the first and second sheets of a two page letter.

When an envelope is to be fed from the envelope cartridge 24, FIG. 5, the upper cartridge scrub roll 44 feeds the front envelope of the vertical stack of envelopes 64 up through the top opening 41 and into a paper guide assembly comprising short and long guide plates 65,66 and two pairs of guide rollers 67,68 and 70,71. From rollers 70,71, the long guide plate 66 guides the envelope between rollers 56,57 and from thence the envelope follows the same path as a sheet of paper into the nip of the idler rollers 61.

In the above described paper guide assemblies for upper and lower paper cartridges 21,22 and envelope cartridge 24, the rollers 56,67 and 70 are driven and rollers 57,68 and 71 are idlers. Referring to FIG. 2, wherein the driven pulley 50 for the lower scrub roller 45 is shown, it can be seen that the pulley 50 in turn drives an auxiliary pulley 72 by means of a timing belt 74. The pulley 72 is fixed on a shaft 75 that extends across the cartridge-guide unit to the opposite or left side thereof where a second pulley 76, FIG. 3, is fixed on the shaft. Pulley 76 is connected by a timing belt 77 to the guide rollers 56,67 and 70 whereby the latter are driven in synchronism with the scrub roll 44 or 45. To this end, the belt 77 is also in operable engagement with a pulley 78 secured to the left end of the shaft for the upper scrub roll 44.

After a sheet of paper from the upper or lower paper cartridge 21 or 22 or an envelope from the envelope cartridge 24 has been rolled around the printer platen 25, FIGS. 4 and 5, and the printing has been completed, the printer rolls the sheet or envelope clear of the platen and into still another paper guide assembly that takes the paper to the receiving station 26 at the top of the feeder. The guide assembly for paper leaving the platen comprises three pairs of guide plates 80, 81; 82,83 and 85,86, and five pairs of guide rollers, the rollers in each pair having the reference numbers 87 and 88. In each pair of guide rollers, the rollers 87 are driven and rollers 88 are idlers.

When the paper emerges from the third pair of guide plates 85,86, it is fed by a continuous belt 90 to the receiving station 26. Belt 90 passes around a drive roller 92 and a series of idler rollers 93,94,95,96 and 97. The belt also passes around and drives a larger idler roller 98 that has a serrated or toothed surface as shown. Idler rollers 96 and 98 extend between and are supported by upstanding bracket members 100 at the opposite sides of the cartridge-guide unit and the terminal roller 97 extends between and is supported by a pair of arms 101 that are pivotally connected to the bracket members on the axis of roller 96.

Paper leaving guide plates 85,86 is picked up by belt 90 and passes under idler rollers 93 and 94, around idler 98 and under idler 97 as indicated in FIG. 4. This roller arrangement turns the sheet of paper over, the sheet passing between plates 85,86 with its printed side up and being turned over as it passes around rollers 94 and 98 whereby it is delivered to the receiving station 26 with its printed side down. This results in the desired first in-first out arrangement or sequence because after a particular run of sheets has passed through the feeder and is stacked as shown, the stack as a whole is picked up and turned over and the sheets are then arranged in the same order that they were fed into the machine. As shown in FIGS. 1, 4 and 5, the receiving station is provided with an adjustably positioned guide plate 102 of conventional construction to keep the stacked sheets in vertical alignment.

When the paper feeder is to process envelopes, the roller 97 and its supporting arms 101 are rotated upwardly to the position shown in FIG. 5. The roller assembly thus has one position for paper sheets and another for envelopes, and the supporting arms are releasably held in one or the other of these positions by a spring biased detent 104 that enters one of two indentations 105. A transversely extending hood 106, FIGS. 1, 2 and 5, is operably connected to roller 97 and arms 101 and rotates with them between the sheet feeding position shown in FIGS. 1 and 2 and the envelope feeding position of FIG. 5.

As with sheets of paper, envelopes pass between the guide plates 85,86 with their printed side up. The envelopes are oriented with their long dimension crosswise to the feeder and as they leave guide plates 86,86 they are picked up by belt 90 and pass under idler rollers 93,94 and then around idler roller 98. Each envelope is moved upwardly by roller 98 until its upper edge engages a lip on spring 107, FIG. 5, at the forward edge of the tipped up hood 106. This stops the upward movement of the envelope but the serrated roller 98 continues rotating and positively carries the lower edge of the envelope forward and down whereby the envelope is positioned at the back of the stack 108 of envelopes as shown. This transitional movement of the envelope is indicated by the phantom lines 110 in FIG. 5.

The envelopes in the stack 108 are positioned with their printed sides facing forwardly and, as will be apparent, in the first in-first out arrangement that is desired. The roller assembly in envelope feeding position also operates to stack the envelopes vertically which enables many more envelopes to be processed than if they were to be stacked horizontally.

The drive means for the driven rollers of the above-described paper guide assembly, extending from the exit side of the printer platen 25 to the receiving station 26, are as follows. The platens of most character printers include a gear (not shown) adjacent one end thereof which gear is utilized for driving the pin or tractor feed. When the interface unit 16, FIG. 2, of the invention is mounted on the printer, a gear 110 in the unit meshes with the platen tractor gear and operates through a train of gears 111,112 in the unit to drive a gear 114 on the shaft of the driven guide rollers 87, FIGS. 4 and 5. Gear 114, mounted on a one way bearing, is connected by a timing belt 115, FIG. 3, to the next driven guide roller 87 above it and the latter is connected by another timing belt 116, FIG. 2, to the next two driven rollers 87. With this arrangement all of these guide rollers 87 are driven in synchronism with the printer platen as it rolls paper around the platen and up into the guide assembly.

From FIG. 3 it can be seen that the upper right roller 87 engaged by the timing belt 116 of FIG. 2 is also engaged by a generally horizontally extending belt 117 that passes around the final guide roller 87 in the series and the driven roller 92, FIGS. 3 and 4. As previously noted, roller 92 drives the continuous belt 90 which in turn drives the idler rollers 93,94,95,96 and 97. The belt 117 is driven by a D.C. motor 118, FIGS. 3 and 4. This motor is inactive as the paper is advancing around the printer platen but when the trail-edge of the paper is sensed by a photo detector 120 located just above the platen, FIGS. 4 and 5, the printer becomes inactive and the motor 118 becomes active and finishes feeding the paper to the receiving station 26.

Figure 6:
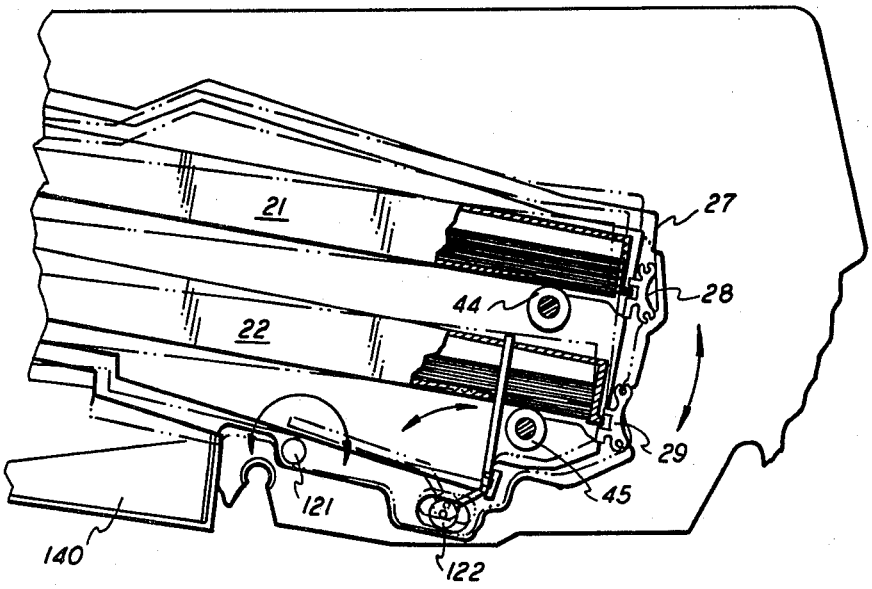
FIG. 6 is a fragmentary elevation with parts broken away showing the rocking action of the cartridge cradle assembly.

Having reference now to FIGS. 4 and 6, it was noted above that the cartridge cradle assembly 27 in which the paper and envelope cartridges are received is rockably mounted in the cartridge-guide unit 15. The reason for this is to permit the cartridges and paper therein to be rocked out of engagement with the scrub rolls 44 and 45, the rocking movement being clockwise in FIG. 4 and counterclockwise in FIG. 6. If this were not done, the insertion of full cartridges into the feeder would cause the exposed bottom sheets thereof to be wrinkled or torn by the scrub rolls and these sheets could thereafter jam the feeder.

FIG. 6 shows in solid lines the cartridge cradle assembly 27 in operative engagement with the scrub rolls. The phantom lines illustrate the cradle assembly after it has been rocked out of engagement with the scrub rolls, the clearance between permitting full cartridges to be inserted into or removed from the assembly without damaging the exposed paper. The cradle assembly is rocked on a pivot 121 by an eccentric element 122 that operates in an opening 124 in the lower portion of the cradle assembly. The eccentric element can be turned to effect the rocking by means of a suitable handle not shown.

Figure 7:
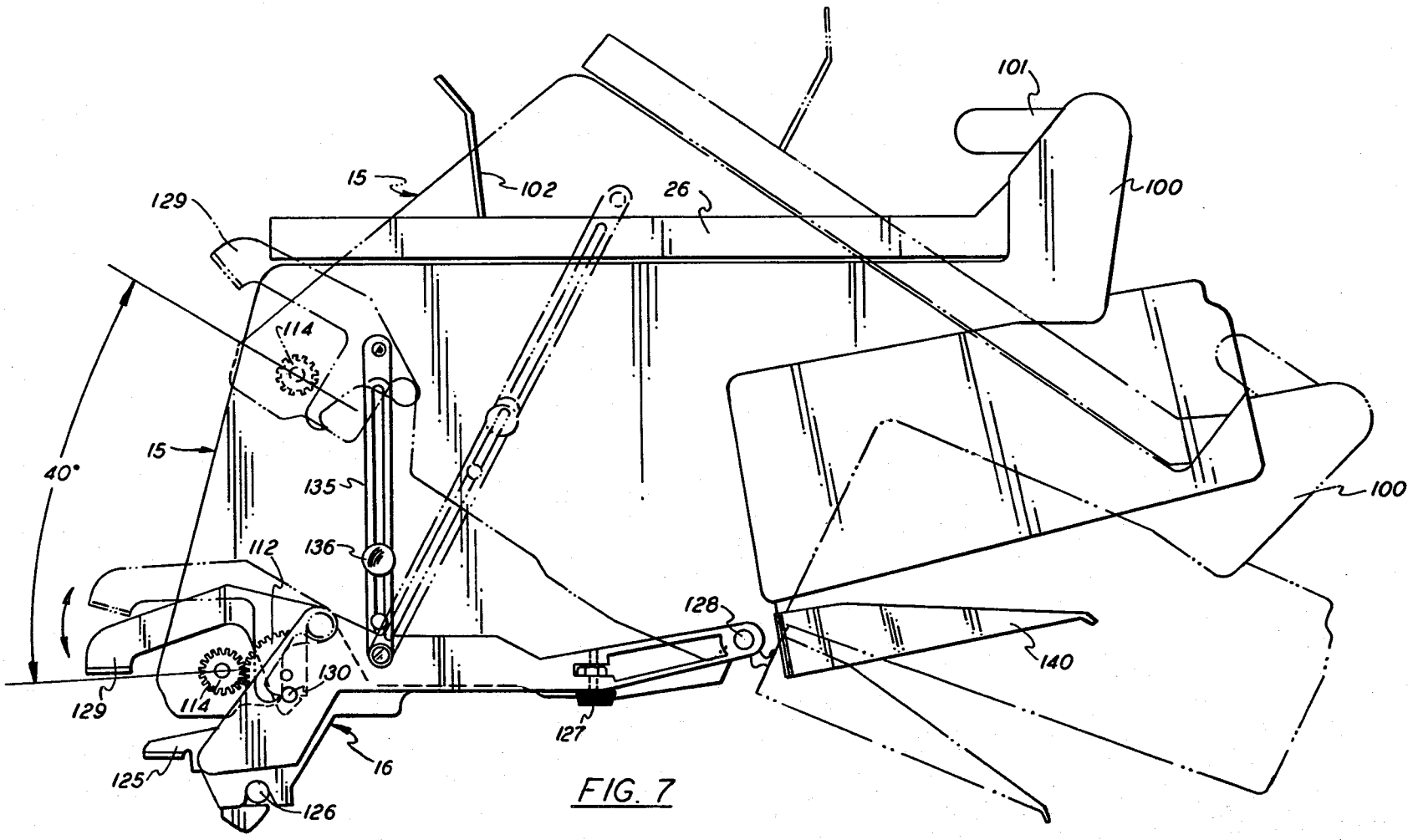
FIG. 7 is a side elevation of the paper feeder in operative and inoperative positions with respect to feeding paper to the character printer.

Referring now to FIGS. 2 and 7, the interface unit 16 is positioned on the top of the character printer and is secured thereto by latch elements 125 that hook under the platen shaft 126 adjacent the ends thereof. The unit 16 includes an adjustable foot 127 on each side to level the unit, and thus the feeder, as necessary. The paper feeder disclosed herein is particularly adapted for use with Qume, Diablo and NEC character printers and the interface unit may be adapted as necessary to fit these and other printers, the construction of the cartridge-guide unit 15 always being the same. Normally, after the interface unit 16 has been mounted on a printer it is not removed except for repairs to the printer.

The cartridge-guide unit 15 is mounted on the interface unit 16, FIGS. 2 and 7, so that it can be tipped or rocked back out of operative engagement therewith as shown in phantom lines in FIG. 7. In such position, the feeder is inactive and there is no driving connection between the printer and cartridge-guide unit because gear 114 for the lowermost guide roller 87 is out of engagement with the gear train 110,111 and 112 in the interface unit. The cartridge-guide unit pivots on a shaft 128 in the interface unit and is normally held in operative engagement therewith by a pair of latch elements 129, the lower hook ends of which engage the opposite ends of a shaft 130 in the interface unit.

The cartridge-guide unit 15 is rocked back out of engagement with the interface unit when the latter is equipped to process continuous forms by the printer. The pin or tractor feed for such forms which is optional is shown at 131 in FIG. 4. The feed units 131 are themselves conventional as is the manner in which the forms are passed around the printer platen. The pin feed units are slidably mounted on a round shaft 132 and square shaft 134, both being part of the interface unit. The shaft 134 is the drive shaft and is driven by gear 112 in the interface unit.

In addition to processing continuous forms, the cartridge-guide unit 15 may be rocked back out of engagement with the interface unit to permit printing on a single sheet in what can be called a "pre-empt" use. To hold the unit in its rocked back position a conventional slide and thumbscrew device 135–136 is provided, FIGS. 2, 3 and 7.

With reference to FIG. 1, the outer housing 17 has an inner lining 137 of foam rubber or the like and this plus the fact that the housing encloses the printer as well as the feeder greatly reduces the noise of operation. The housing is provided with a top hinged front door 138 for access to the printer and feeder.

The cartridge-guide unit 15 includes a shelf member 140, FIGS. 2–7, for supporting printed circuit boards (not shown) or the like. As shown in FIGS. 2 and 3, the various idler rollers in the paper guide assemblies are urged into engagement with their corresponding driven rollers by springs 141 mounted on the left and right side plates 18 and 20. As also shown in these Figures, one-way bearing caps 142 are provided for the driven rollers.

In operation, paper from one of the cartridges selected under program control is fed to the nip of the idler rollers at the rear of the printer platen. This provides registration relative to the platen. A command is then sent to the printer to roll the paper around the platen and position it to be checked by a photo sensor (not shown) for proper registration. If the form is properly registered against the photo sensor, a command is issued to the printer to register the form for printing on line one. Control at this time is turned over to the host system and the paper feeder becomes inactive.

When printing is complete, the system sends an ASCII Form Feed character with a Character Strobe or energizes a Top of Form line or other appropriate means. The feeder, even though inactive during printing, monitors the data lines and when a Form Feed Character is detected, monitors printer activity. When execution is complete in the printer, the feeder inhibits further commands from the host system and assumes control of the printer. The feeder issues a command to the printer to roll the form clear of the printer platen. The feeder then feeds the forms to the receiving station where it is stacked face down in a first in-first out manner. A new form is then inserted in the manner previously described.

From the foregoing description, it will be apparent that the invention disclosed herein provides a novel and very versatile paper feeder for use with a character printer. As will be understood by those familiar with the art, the invention may be embodied in other specific forms without departing from the spirit or essential characteristics thereof.

We claim:

1. An automatic paper feeder for use with a character printer having a platen, the feeder comprising an interface unit mounted on the printer and a paper cartridge-guide unit mounted on the interface unit, a cartridge cradle assembly mounted in the cartridge-guide unit, the cradle assembly being adapted to receive paper containing cartridges of different types, one type of cartridge being adapted to contain cut paper and another type of cartridge being adapted to contain envelopes, scrub roll and guide means for removing paper from either type of cartridge and guiding it to the printer platen, a receiving station forming a part of the cartridge-guide unit for receiving paper that has left the platen, and a paper guide assembly for guiding paper leaving the printer platen to the receiving station, the guide assembly having a terminal portion movable between a first and second position, the terminal portion in its first position being operable to deliver cut paper to the receiving station in a first in-first out arrangement, and the terminal portion in its second position being operable to deliver envelopes to the receiving station in a first in-first out arrangement.

2. An automatic paper feeder as defined in claim 1 wherein the cartridge cradle assembly is rockably mounted in the housing to facilitate inserting loaded cartridges into the chassis.

3. An automatic paper feeder as defined in claim 1 wherein the cartridge cradle assembly is adapted to receive one or both of a pair of cut paper containing cartridges.

4. An automatic paper feeder as defined in claim 1 wherein the cartridge cradle assembly is adapted to receive an envelope containing cartridge.

5. An automatic paper feeder as defined in claim 1 including an outer sound minimizing housing that encloses the paper feeder and character printer.

6. An automatic paper feeder as defined in claim 1 wherein the interface unit includes a pin feed for moving continuous forms around the printer platen.

7. An automatic paper feeder as defined in claim 1 wherein the paper cartridge-guide unit is rockably mounted on the interface unit, the cartridge-guide unit including releasable latch means normally preventing relative rockable movement.

8. An automatic paper feeder for use with a character printer having a platen, the feeder comprising a paper cartridge-guide unit operably connected to the printer, a cartridge cradle assembly rockably mounted in the unit, the cradle assembly being adapted to receive paper containing cartridges of different types, one type of cartridge being adapted to contain cut paper and another type of cartridge being adapted to contain envelopes, a scrub roll for each type of cartridge for removing paper therefrom, means for rocking the cartridge cradle assembly to move the paper contained therein into or out of engagement with its associated scrub roll, means for guiding paper from either type of cartridge to the printer platen, a receiving station forming a part of the cartridge-guide unit for receiving paper that has left the platen, and a paper guide assembly for guiding paper leaving the printer platen to the receiving station, the guide assembly having a terminal portion movable between a first and second position, the terminal portion in its first position being operable to deliver cut paper to the receiving station in a first in-first out arrangement, and the terminal portion in its second position being operable to deliver envelopes to the receiving station in a first in-first out arrangement.

9. An automatic paper feeder as defined in claim 8 wherein the cartridge cradle assembly is adapted to receive one or both of a pair of cut paper containing cartridges, there being a separate scrub roll and guide means for each cartridge of the pair.

10. An automatic paper feeder as defined in claim 8 wherein the cartridge adapted to contain envelopes is formed with a front opening and a top wall slot adjacent the front opening, the scrub roll associated with the cartridge being operable to engage an envelope through the front opening and eject it through the top wall slot.

11. An automatic paper feeder as defined in claim 8 including an interface unit positioned between the paper cartridge-guide unit and character printer, the interface unit including a pin feed operable to move continuous forms around the printer platen.

12. An automatic paper feeder as defined in claim 11 including an outer sound minimizing housing that encloses the paper cartridge-guide unit, the interface unit and the character printer.

13. An automatic paper feeder as defined in claim 11 wherein the paper cartridge-guide unit is rockably mounted on the interface unit, the cartridge-guide unit including releasable latch means normally preventing relative rockable movement, the cartridge-guide unit being rocked back and away from the printer platen when the latch means is released to permit printing on continuous forms or single sheet printing disassociated from the paper feeder.

14. An automatic paper feeder for use with a character printer having a platen, an interface unit mounted on the printer, the unit including a pin feed for moving continuous forms around the printer platen, a paper cartridge-guide unit rockably mounted on the interface unit, the cartridge-guide unit having releasable latch means normally engaging the interface unit to prevent rocking movement of the cartridge-guide unit, a cartridge cradle assembly mounted in the cartridge-guide unit, the cradle assembly being adapted to receive paper containing cartridges of different types, one type of cartridge being adapted to contain cut paper and another type of cartridge being adapted to contain envelopes, roller and guide means for removing paper from either type of cartridge and guiding it to the printer platen, a receiving station forming a part of the cartridge-guide unit for receiving paper that has left the platen, and a paper guide assembly for guiding paper leaving the printer platen to the receiving station, the cartridge-guide unit being held in operable engagement with the interface unit by its latch means when paper from a cartridge is being printed upon, said latch means being released and the cartridge-guide unit being rocked back and away from the printer platen when the printer is printing on continuous forms.

15. An automatic feeder as defined in claim 14 wherein the interface unit includes a gear train connecting the printer platen with the guide assembly whereby the guide assembly is driven in synchronism with the printer platen.

16. An automatic paper feeder as defined in claim 14 wherein the guide assembly for guiding paper leaving the printer platen to the receiving station includes a terminal portion movable between a first and second position, the terminal portion in its first position being operable to deliver cut paper to the receiving station in a first in-first out arrangement and the terminal portion in its second position being operable to deliver envelopes to the receiving station in a first in-first out arrangement.

17. An automatic paper feeder as defined in claim 16 wherein the terminal portion of the guide assembly includes a serrated roller and means coactable with the serrated roller when the terminal portion is in its second position to deliver each successive envelope in a vertical position at the back of a vertical stack of envelopes.

* * * * *